US005628362A

United States Patent [19]

Rew et al.

[11] Patent Number: 5,628,362

[45] Date of Patent: May 13, 1997

[54] FIN-TUBE TYPE HEAT EXCHANGER

[75] Inventors: Ho S. Rew, Seoul; Seok-Whan Han, Bucho, both of Rep. of Korea

[73] Assignee: Goldstar Co., Ltd., Seoul, Rep. of Korea

[21] Appl. No.: 355,995

[22] Filed: Dec. 14, 1994

[30] Foreign Application Priority Data

| | | | |
|---|---|---|---|
| Dec. 22, 1993 | [KR] | Rep. of Korea | 29 066/1993 |
| Feb. 23, 1994 | [KR] | Rep. of Korea | 3311/1994 |

[51] Int. Cl.[6] ..... F28D 1/04

[52] U.S. Cl. ..... 165/151

[58] Field of Search ..... 165/151

[56] References Cited

U.S. PATENT DOCUMENTS

| | | | |
|---|---|---|---|
| 1,453,250 | 4/1923 | Schnoeckel | 165/151 |
| 4,715,437 | 12/1987 | Tonaka et al. | 165/151 |
| 4,832,117 | 5/1989 | Kato et al. | 165/151 |
| 4,923,002 | 5/1990 | Haussmann | 165/151 |
| 4,984,626 | 1/1991 | Esformes et al. | 165/151 |
| 5,224,538 | 7/1993 | Jacoby | 165/166 |
| 5,318,112 | 6/1994 | Gopin | 165/151 |

FOREIGN PATENT DOCUMENTS

| | | | |
|---|---|---|---|
| 0206384 | 9/1987 | Japan | 165/151 |
| 0099495 | 4/1988 | Japan | 165/151 |

*Primary Examiner*—John Rivell
*Assistant Examiner*—Christopher Atkinson
*Attorney, Agent, or Firm*—David E. Lovejoy

[57] ABSTRACT

A fin-tube type heat exchanger having improved heat transfer rate is disclosed. The heat exchanger effectively restricts forming of separation bubbles on the back surfaces of the tubes fitted to the fin bodies, thus to promote smooth air flow in the heat exchanger and to improve heat transfer rate. The heat exchanger has the vertically placed fin bodies, the tubes horizontally penetrating the fin bodies, a plurality of dimples provided on opposed side surfaces of the fin bodies, and separation bubble controllers for reducing the size of separation bubbles formed about the tubes. The bubble controllers are provided on the opposed side surfaces of the fin bodies about the tubes. In another embodiment, the heat exchanger has no bubble controller but reduces the size of the separation bubbles by controlling configurations and directions of the dimples.

10 Claims, 8 Drawing Sheets

FIN-TUBE TYPE HEAT EXCHANGER

BACKGROUND OF THE INVENTION

1. Field of the Invention

The present invention relates in general to a fin-tube type heat exchanger and, more particularly, to a structural improvement in such a fin-tube type heat exchanger not only for improving heat transfer rate between a fin body and air by forming dimples on the exterior surface of the fin body and but also for facilitating production of the fin-tube type heat exchanger.

2. Description of the Prior Art

With reference to FIGS. 1 to 3, there is shown an example of a typical fin-tube type heat exchanger. In the drawing, the reference numeral 1 denotes a thin plate type fin body. The heat exchanger includes a plurality of fin bodies 1 which are vertically placed in parallel and spaced out at regular intervals. A plurality of tubes 2 laterally penetrate the vertically placed fin bodies 1, so that the tubes 2 are horizontally arranged in the heat exchanger. The tubes 2 are spaced out at regular intervals.

At this time, the tubes 2 are tightly fitted to the fin bodies 1 in such a manner that the opposed ends of the tubes 2 project out of the outside surfaces of the outermost fin bodies 1 respectively. The tubes 2 are tightly fitted to the fin bodies 1 at their contact parts. In order to tightly fit the tubes 2 to the fin bodies 1 at the contact parts, the tubes 2 are fitted into the fin bodies 1 and, thereafter, high pressure air is introduced into the tubes 2 so as to tightly fit the tubes 2 to the fin bodies 2.

As shown in FIGS. 1 to 3, the exterior surface of each fin body 1 is provided with a plurality of louvered fins 3 of a predetermined same shape on their sections free from the tubes 2.

The heat exchanging operation of the above fin-tube type heat exchanger will be described with reference to, for example, an evaporating heat exchanger for an air conditioner.

As well known to those skilled in the art, the temperature of refrigerant flowing in the tubes 2 of the heat exchanger 50 used in the air conditioner is lower than that of the air introduced into the heat exchanger 50. In addition, aluminum typically used as the material of the fin body 1 has an excellent thermal conductivity remarkably higher than that of the air. Therefore, thermal conduction heat transfer is generated in the heat exchanger in order of refrigerant→tubes 2→fin bodies 1 when the refrigerant flows in the tubes 2.

Thereafter, the air introduced into the interior of the heat exchanger 50 comes into contact with not only the exterior surfaces of the fin bodies 1 but also the louvered fins 3 of the fin bodies 1. Therefore, there is a heat transferring action by convection between both the exterior surfaces of the fin bodies 1 and the louvered fins 3 and the air introduced into the heat exchanger 50, thus to let the refrigerant flowing in the tubes 2 evolve or absorb the heat to or from the air.

There have been studied for improving the operational efficiency of heat exchanger by increasing the heat transfer rate by convection between the exterior surfaces of the fin bodies 1 and the air introduced into the heat exchanger 50.

When the air passes by the tubes 2 during its introduction into the heat exchanger 50, separation bubbles are formed about the back surfaces of the tubes 2 due to intrinsic characteristics of air current about the tubes 2 as shown in FIGS. 2 and 4.

At the tube sections having the separation bubbles, the air flow velocity is reduced due to increase of air flow resistance about the tube sections. Therefore, the heat transfer rate of the tube sections having the separation bubbles is lower than that of the other tube sections having no separation bubble.

As described above, the air current characteristics about the tubes 2 exert an important effect upon the heat transfer rate by convection between the exterior surfaces of the fin bodies 1 and the air introduced into the heat exchanger 50.

In an effort to overcome the problem caused by the separation bubbles of the heat exchanger 50 of FIGS. 2 and 3, the louvered fins of the exterior surfaces of the fin bodies 1 may be slitted into thinner louvered fins 4 as shown in FIGS. 4 and 5. In this case, the sizes of the separation bubbles formed about the tubes 2 are reduced, so that it may be possible to improve the heat transfer rate by convection between the exterior surface of the fin bodies 1 and the air introduced into the heat exchanger 50.

However in the above fin-tube type heat exchanger, the thin fin bodies should be provided with the plurality of louvered fins thereon and, furthermore, the louvered fins should be slitted into thinner louvered fins during a louvered fin forming step. In this regard, the above fin-tube type heat exchanger has a problem that a complicated mold should be prepared for production of the heat exchanger. In addition, when the slitted louvered fins have complicated configurations, another problem such as sudden break of the fin bodies may be caused in production of the heat exchanger. A further problem of the above fin-tube type heat exchanger is resided in that the heat exchanger can not effectively reduce the size of the separation bubbles, which bubbles are formed on the back surfaces of the tubes due to air current about the tubes.

SUMMARY OF THE INVENTION

It is, therefore, an object of the present invention to provide a fin-tube type heat exchanger in which the above problems can be overcome and which effectively restricts forming of separation bubbles on the back surfaces of the tubes fitted to the fin bodies of the heat exchanger, thus to promote smooth air flow about the heat exchanger and to improve heat transfer rate between the tubes and the air introduced into the heat exchanger.

In order to accomplish the above object, a fin-tube type heat exchanger in accordance with an embodiment of the present invention comprises: a fin body of the thin plate type, the fin body being vertically placed in the heat exchanger; a plurality of tubes horizontally penetrating the vertically placed fin body, the tubes being spaced out at regular intervals; a plurality of dimples provided on predetermined positions of opposed side surfaces of the fin body; and a separation bubble control means for reducing the size of a separation bubble formed about each of the tubes, the bubble control means being provided on the opposed side surfaces of the fin body about each of the tubes.

In another embodiment, the heat exchanger has no bubble control means but reduces the size of the separation bubbles by controlling configurations and directions of the dimples.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 6A:
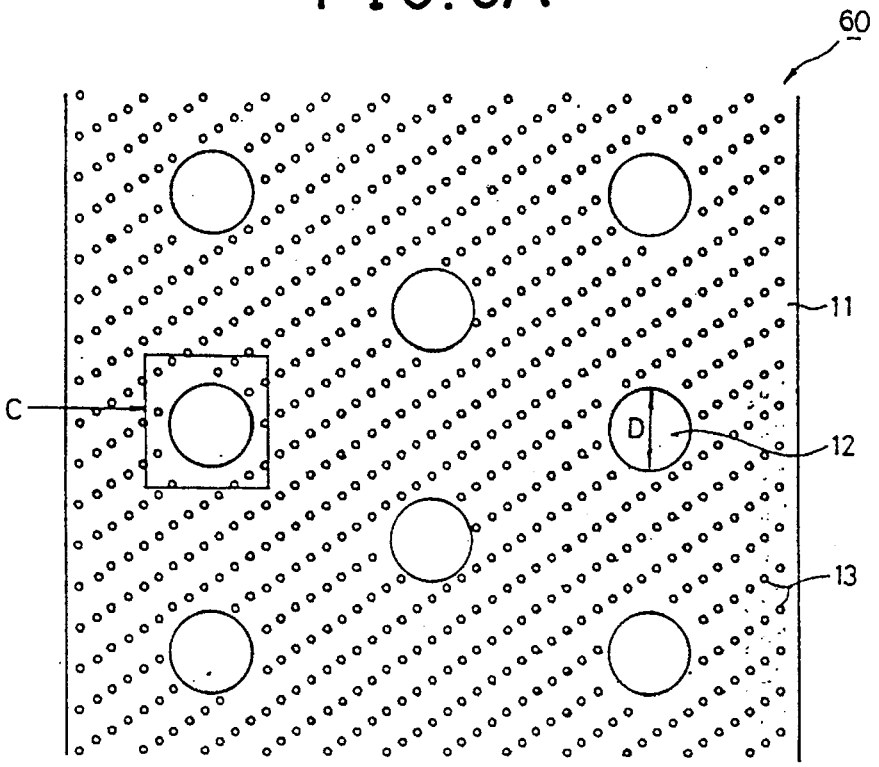
FIG. 6A is a side view of a fin-tube type heat exchanger in accordance with a first embodiment of the present invention.
Figure 6B:
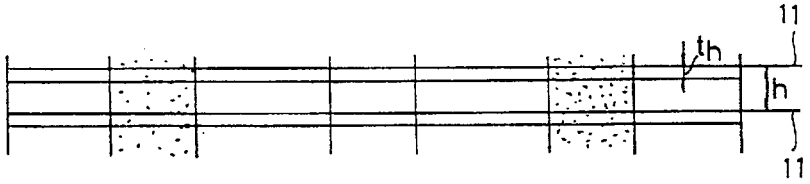
FIG. 6B is a plan view of the fin-tube type heat exchanger of FIG. 6A.
Figure 7:
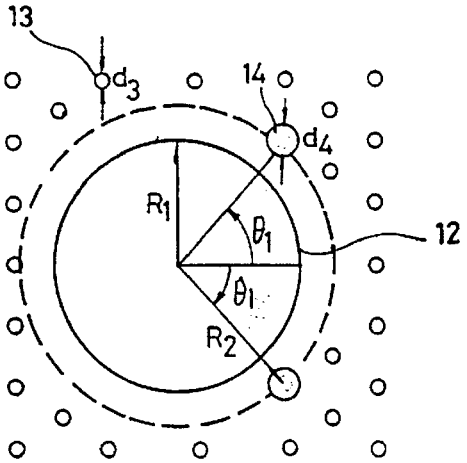
FIG. 7 is an enlarged view of the section C of the heat exchanger of FIG. 6A.

FIGS. 6A and 6B are side and plan views of a fin-tube type heat exchanger in accordance with a first embodiment of the present invention respectively. FIG. 7 is an enlarged view of the section C of the heat exchanger of FIG. 6A.

Figure 1:
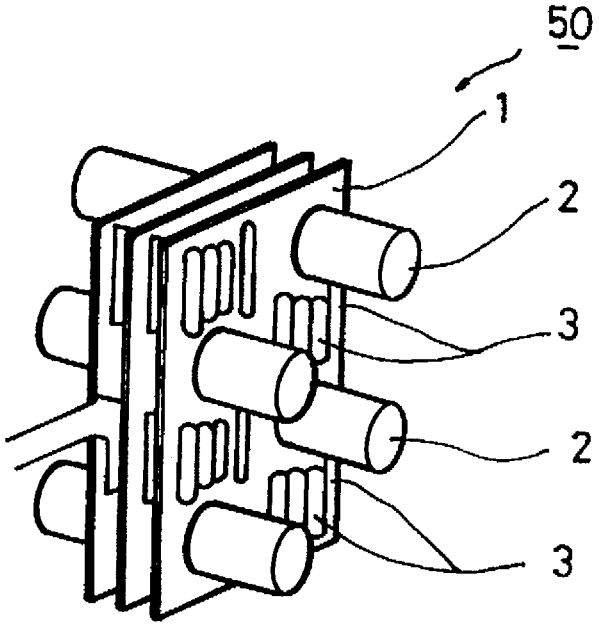
FIG. 1 PRIOR ART
FIG. 1 is a perspective view of an embodiment of a typical fin-tube type heat exchanger.
Figure 2:
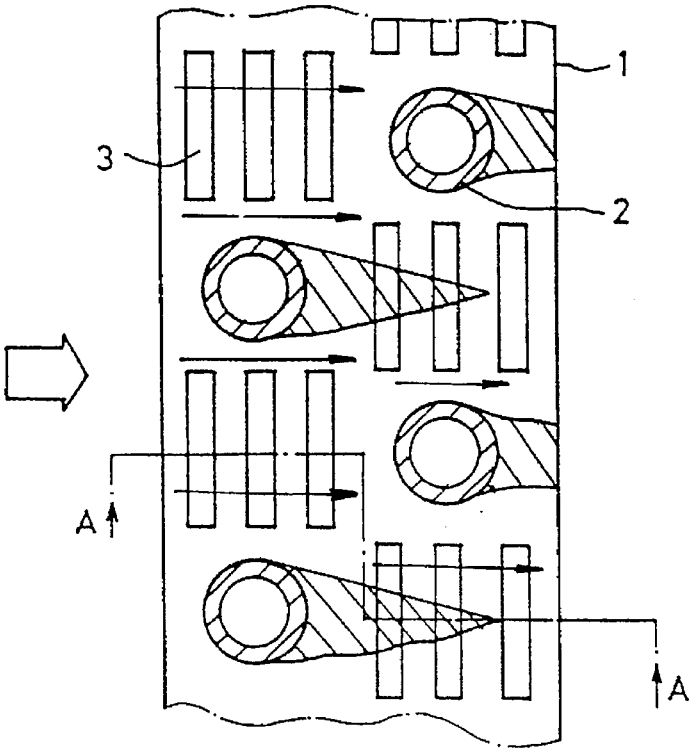
FIG. 2 PRIOR ART
FIG. 2 is a side view of the fin-tube type heat exchanger of FIG. 1.
Figure 3:
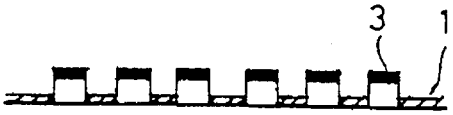
FIG. 3 PRIOR ART
FIG. 3 is a sectional view of the fin-tube type heat exchanger taken along the section line A—A of FIG. 2.
Figure 4:
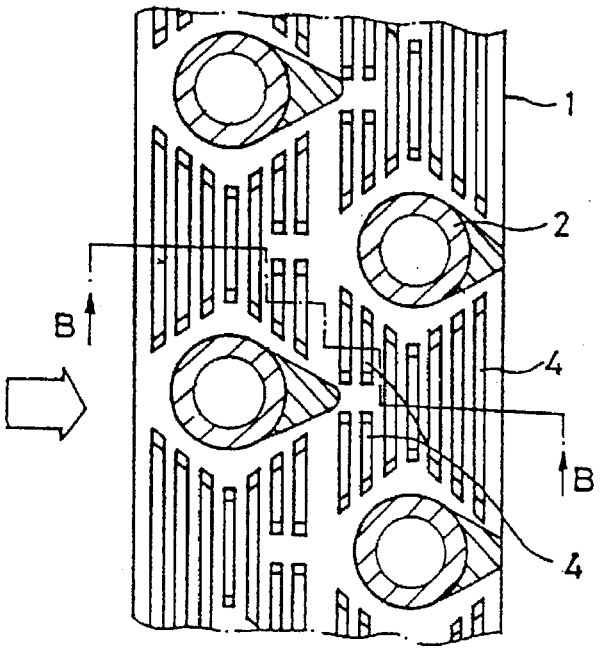
FIG. 4 PRIOR ART
FIG. 4 is a side view of another embodiment of a typical fin-tube type heat exchanger.
Figure 5:
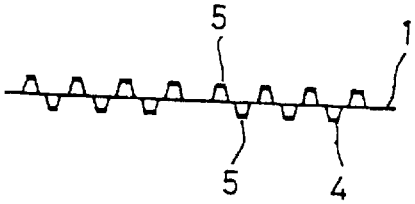
FIG. 5 PRIOR ART
FIG. 5 is a sectional view of the fin-tube type heat exchanger taken along the section line B—B of FIG. 4.

As shown in the drawings, the general shape of the fin-tube type heat exchanger 60 of the first embodiment remains the same as described for the prior heat exchanger of FIGS. 2 and 3, but a plurality of dimples 13 instead of the typical louvered fins are provided on the surfaces of the fin bodies 11. In addition, the surfaces of the fin bodies 11 are provided with a plurality of separation bubble controllers 14 about the tubes 12 as shown in FIG. 7, which controllers 14 are adapted for reducing the size of separation bubbles formed about the tubes 12.

In forming the dimples 13 on the surfaces of the fin bodies 11, it is preferred to let the relation between the height $t_h$ of each dimple 13 and the interval h between adjacent fin bodies 11 be defined by the inequality $0.01\ h \leqq t_h \leqq 0.7\ h$. When letting the relation between the height of each dimple 13 and the interval between the adjacent fin bodies 11 as described above, the surface area of each fin body 11 will be increased and an appropriate interval between the dimples 13 of a tube body 11 and an adjacent tube body 11 will be kept.

In addition, the dimples 13 and the separation bubble controllers 14 are designed in such a manner that the relation between the outer diameter $d_3$ of each dimple 13 and the outer diameter $d_4$ of each separation bubble controller 14 is defined by the inequality $d_3 \leqq d_4$.

The positions of the bubble controllers 14 formed about each tube 12 are set in the following manner. That is, when letting an angle resulting from division of an angle between adjacent bubble controllers 14 about each tube 12 into two equal parts be $\theta_1$ as shown in FIG. 7, the angle $\theta_1$ suitable for guiding the air introduced to the fin body 11 and for reducing the size of the separation bubble about the tube 12 is set within the range from 45° to 120°, that is, $45° < \theta_1 < 120°$. When letting the radius of each tube 12 be $R_1$, letting the outer diameter of each separation bubble controller 14 be $d_4$, and letting the radius of an assumed circle formed by the plurality of bubble controllers 14 be $R_2$, the center position of each bubble controller 14 is defined by the inequality $(R_1+d_4/2)<R_2<(R_1+2d_4)$.

Figure 8:
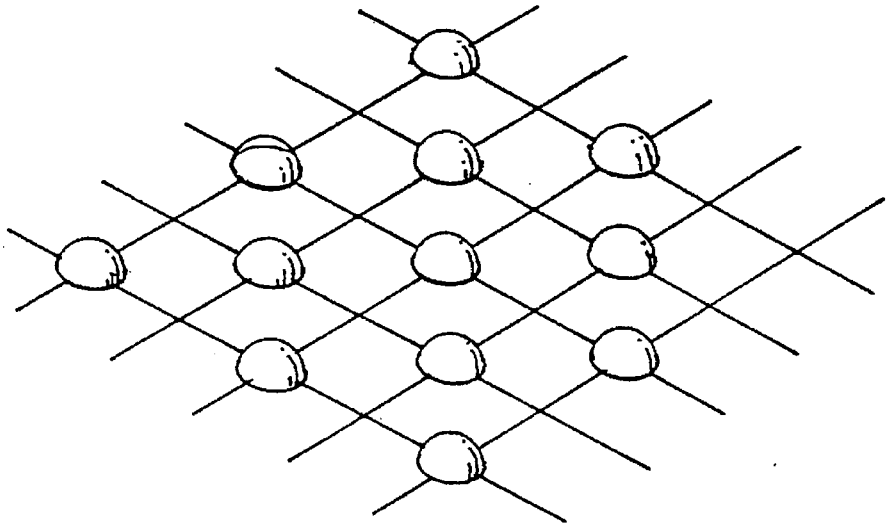
FIG. 8 is a perspective view showing dimples of the heat exchanger of FIG. 6A.
Figure 9:
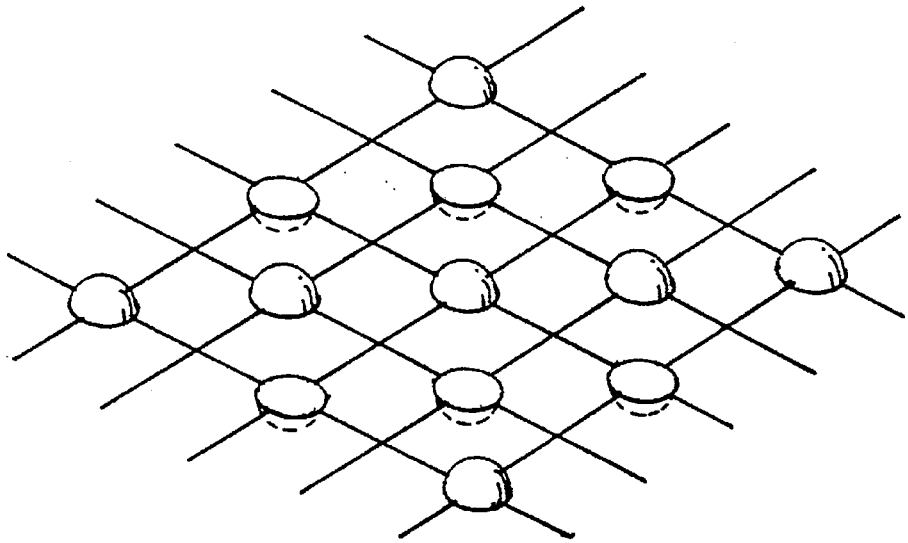
FIG. 9 is a perspective view of another embodiment of dimples of the heat exchanger of FIG. 6A.

In the invention, the dimples 13 of the fin body 11 may have the configurations shown in FIG. 8. Alternatively, the dimples 13 of the fin body 11 may have the configurations shown in FIG. 9.

The operational effect of the fin-tube type heat exchanger of the first embodiment of the invention will be described hereinbelow.

When refrigerant flows in the tubes 12 of the heat exchanger 60, there is generated thermal conduction heat transfer between the refrigerant and the tubes 12 as well as thermal conduction heat transfer between the tubes 12 and the fin bodies 11.

The air introduced into the heat exchanger 60 comes into contact with not only the exterior surfaces of the fin bodies 11 but also the dimples 13 formed on the fin bodies 11. Thus, there is generated heat transfer by convection between the air introduced into the heat exchanger 60 and both the exterior surfaces of the fin bodies 11 and the dimples 13.

At this time, when the air passes by the tubes 12, there may be generated separation bubbles on the back surfaces of the tubes 12 due to air current characteristics about the tubes 12. However, the size of each separation bubble or the effective range of each separation bubble is remarkably reduced owing to the presence of the bubble controllers 14 formed about an associated tube 14. Therefore, the heat transfer rate of the tubes 12 is prominently improved in comparison with the typical fin-tube type heat exchanger.

Figure 10:
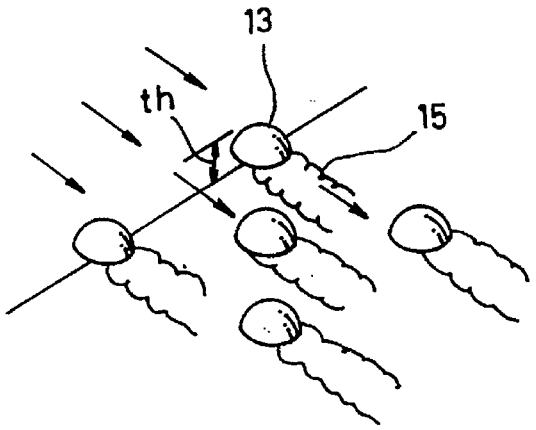
FIG. 10 is a perspective view showing an operational effect of the dimples of the heat exchanger of FIG. 6A.

That is, the heat transferring area of the heat exchanger 60 of the first embodiment is remarkably increased due to the dimples 13 formed on the surfaces of the fin bodies 11 as shown in FIG. 10. In addition, the bubble controllers 14 let a horsehue vertex, which vortex generally appears in air flow about a cylinder with a flat wall, be formed about each tube 12, thus to improve the heat transfer by convection between the air introduced into the heat exchanger 60 and the exterior surfaces of the fin bodies 11.

Figure 11:
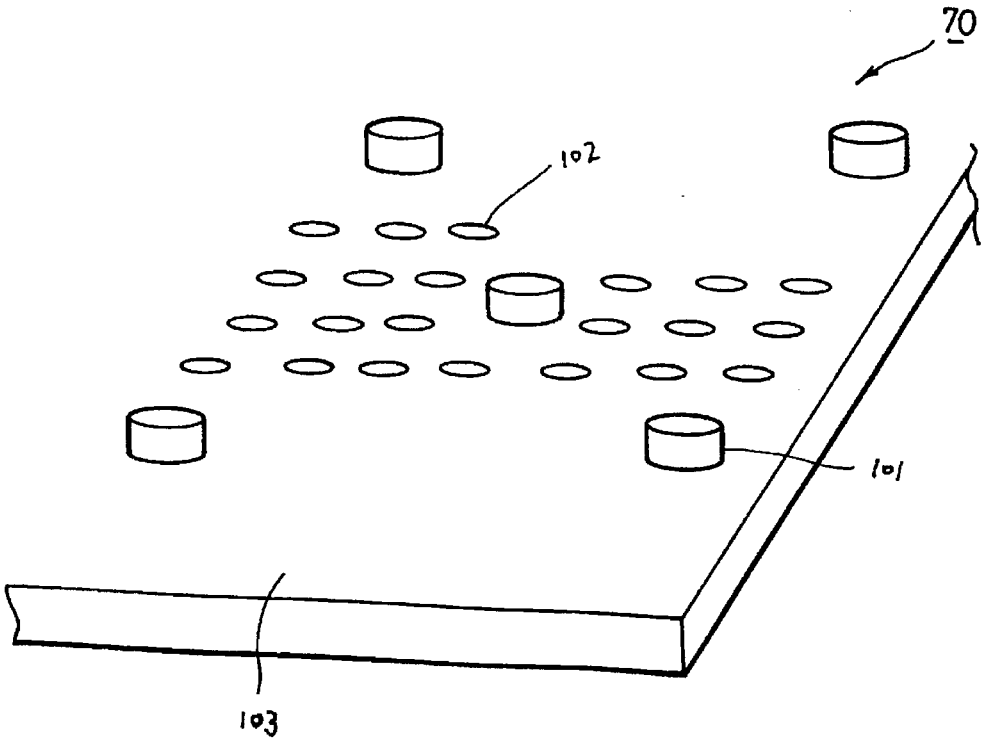
FIG. 11 is a perspective view of a fin-tube type heat exchanger in accordance with a second embodiment of the present invention.

Turning to FIG. 11, there is shown a fin-tube type heat exchanger in accordance with a second embodiment of the present invention.

Figure 12A:
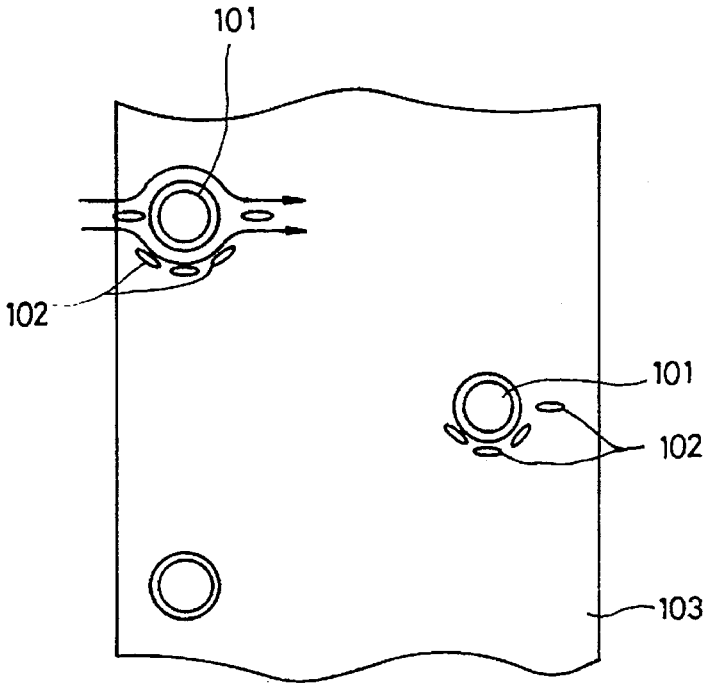
FIG. 12A is a side view of the fin-tube type heat exchanger of FIG. 11.
Figure 12B:
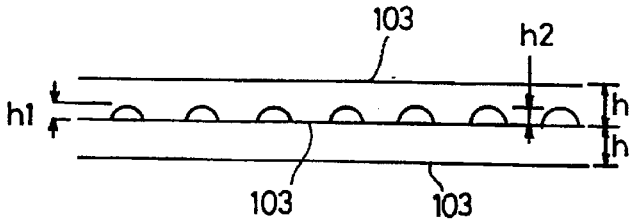
FIG. 12B is a plan view of the fin-tube type heat exchanger of FIG. 11.
Figure 12C:
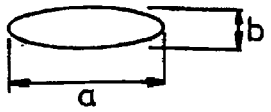
FIG. 12C is an enlarged view of a dimple of the heat exchanger of FIG. 11.

In the fin-type heat exchanger 70 of the second embodiment, the general shape of the heat exchanger remains the same as that of the heat exchanger of the first embodiment as shown in FIGS. 11, 12A, 12B and 12C, but the configurations of the dimples are altered. That is, the heights of the dimples 102 differ from each other in such a manner that the height $h_2$ of the dimple 102 placed in the rear section of the fin body 103 in the direction of air flow is higher than the height $h_1$ of the dimple 102 placed in the front section of the fin body 102 as shown in FIG. 12B. In addition, each dimple 102 has an oval configuration in that the horizontal diameter "a" of each dimple 102 or the diameter parallel to the direction of air flow of the two diameters "a" and "b" perpendicular to each other is longer than the vertical diameter "b" of each dimple 102 or the diameter perpendicular to the direction of air flow, that is, a>b, as shown in FIG. 12C.

Furthermore, the dimples 102 are positioned relative to each tube 101 such that the longer diameters of the dimples 102 are arrayed in the tangential direction of each tube 101 as shown in FIG. 12A.

In the heat exchanger of the second embodiment, the fin bodies 103 have no separation bubble controller differently from the first embodiment. In this second embodiment, the sizes of the separation bubbles formed about the tubes 103 will be reduced by controlling configurations and directions of the dimples 102.

Since the fin bodies 103 of the heat exchanger 70 of the second embodiment has the plurality of oval dimples 102 whose longer diameters are directed in the air flow direction about the fin bodies 103 as described above, the air flow passages about the tubes 101 are lengthened as shown in FIG. 12A, thus to improve the heat transfer rate of the tubes 101.

As the dimples 102 are positioned relative to each tube 101 such that the dimples 102 are directed in the tangential direction of each tube 101 as shown in FIG. 12A, the air introduced to the fin bodies 103 is efficiently guided to the tubes 101.

The size of the separation bubbles formed about the tubes 101 is thus preferably reduced and, furthermore, the heat transfer rate between the air introduced into the heat exchanger 70 and the exterior surfaces of the fin bodies 103 is improved.

In addition, the heights of the dimples 102 differ from each other in such a manner that the height $h_2$ of the dimple 102 placed in the rear section of the fin body 103 in the direction of air flow is higher than the height $h_1$ of the dimple 102 placed in the front section of the fin body 102 as shown in FIG. 12B. The surface areas of the rear dimples 102 are thus increased.

With such a difference of surface area between the front dimples 102 and the rear dimples 102, the heat exchanger compensates for the heat transfer rate of the air passing by the rear dimples 102, which heat transfer rate is relatively lower than that of the air passing by the front dimples 102. Hence, the heat transfer rate between the air introduced into the heat exchanger 70 and the exterior surfaces of the fin bodies 103 is improved.

Figure 13A:
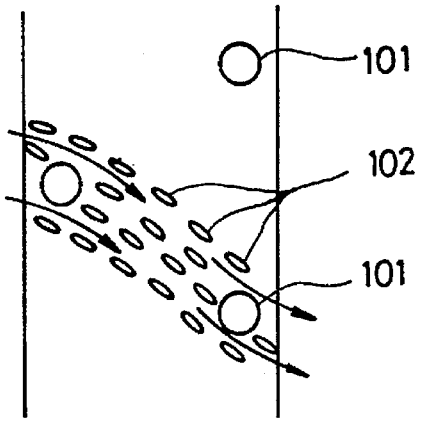
FIGS. 13A to 13C are side views showing different air currents about fin bodies of the heat exchanger of FIG. 11 in accordance with positions of dimples formed on the fin bodies respectively.
Figure 13B:
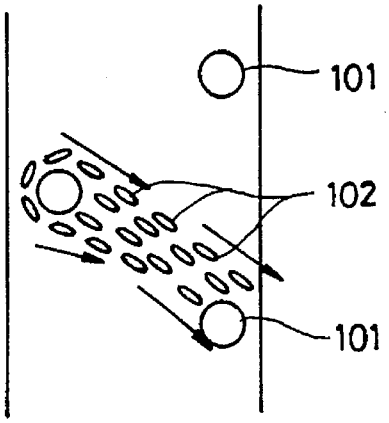
Figure 13C:
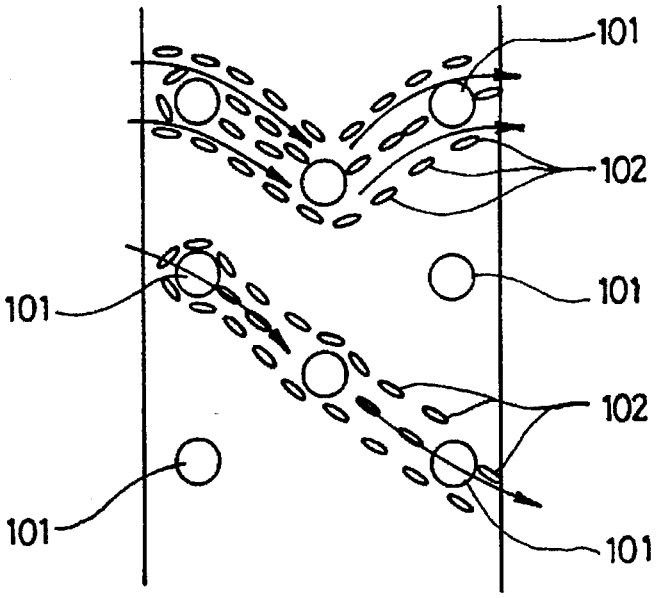

FIGS. 13A to 13C are side views showing different air currents about fin bodies 103 in accordance with positions of dimples 102 formed on the fin bodies 103 of the heat exchanger of FIG. 11 respectively.

As described above, the present invention provides a fin-tube type heat exchanger which improves heat transfer rate between a fin body and the air by forming dimples instead of typical louvered fins on the exterior surface of the fin body. Provision of the dimples instead of the louvered fins also facilitate production of the fin-tube type heat exchanger. In the fin-tube type heat exchanger of the invention, the heat transfer rate between the air introduced into the heat exchanger and the exterior surface of the fin bodies is improved either by forming of separation bubble controllers about the tubes or by controlling configurations and directions of the dimples about the tubes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fin-tube type heat exchanger comprising:

a fin body of the thin plate type;

a plurality of tubes perpendicularly penetrating said fin body, said tubes being spaced out at regular intervals;

a plurality of projecting dimples provided on predetermined positions of opposed side surfaces of said fin body; and a separation bubble control means tangentially formed about each of said tubes, said bubble control means being provided on the opposed side surfaces of said fin body about each of said tubes for reducing the size of a separation air bubble at each of said tubes.

2. The fin-tube type heat exchanger according to claim 1, wherein said tubes are tightly fitted to said fin body in such a manner that opposed ends of the tubes project out of the opposed side surfaces of the fin body.

3. The fin-tube type heat exchanger according to claim 1, wherein said heat exchanger includes a plurality of fin bodies, said fin bodies being vertically placed in parallel and spaced out at regular intervals.

4. The fin-tube type heat exchanger according to claim 1, wherein said dimples are designed in such a manner that the relation between a height "$t_h$" of each of said dimples and an interval "h" between adjacent fin bodies is defined by the inequality $0.01\ h \leqq t_h \leqq 0.7\ h$.

5. The fin-tube type heat exchanger according to claim 1, wherein said separation bubble control means is designed in such a manner that the relation between an outer diameter $d_3$ of each of said dimples and an outer diameter $d_4$ of said separation bubble control means is defined by the inequality $d_3/d_4 \leqq 1$.

6. The fin-tube type heat exchanger according to claim 1, wherein a position of said separation bubble control means is defined by the inequality $$45° < \theta_1 < 120°$$

wherein $\theta_1$ is an angle between said separation bubble control means and the center of a back surface of each of said tubes.

7. The fin-tube type heat exchanger according to claim 1, wherein a position of said separation bubble control means is defined by the inequality $$(R_1 + d_4/2) < R_2 < (R_1 + 2d_4)$$

wherein $R_1$ is a radius of each of said tubes, $d_4$ is an outer diameter of said separation bubble control means, and $R_2$ is a radius of an assumed circle formed by said separation bubble control means.

8. The fin-tube type heat exchanger according to claim 1, wherein the projecting heights of the dimples differ from each other in such a manner that the height of a dimple provided in a rear section of the fin body with respect to the direction of air flow is higher than the height of a dimple placed in the front section of the fin body.

9. The fin-tube type heat exchanger according to claim 1, wherein each of said dimples has an oval shape.

10. The fin-tube type heat exchanger according to claim 1, wherein the dimples arranged about each of said tubes are positioned tangentially to each of said tubes.

* * * * *